US011091352B2

(12) United States Patent
Fauconnet et al.

(10) Patent No.: US 11,091,352 B2
(45) Date of Patent: Aug. 17, 2021

(54) ELEVATOR CAR FRAME

(71) Applicant: Otis Elevator Company, Farmington, CT (US)

(72) Inventors: Aurelien Fauconnet, Isdes (FR); Frederic Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 216 days.

(21) Appl. No.: 16/392,719

(22) Filed: Apr. 24, 2019

(65) Prior Publication Data

US 2019/0330023 A1 Oct. 31, 2019

(30) Foreign Application Priority Data

Apr. 27, 2018 (EP) ..... 18305531

(51) Int. Cl.
*B66B 11/02* (2006.01)

(52) U.S. Cl.
CPC ..... *B66B 11/0246* (2013.01); *B66B 11/0206* (2013.01)

(58) Field of Classification Search
CPC ..... B66B 11/0246; B66B 11/0206
See application file for complete search history.

(56) References Cited

U.S. PATENT DOCUMENTS 4,043,430 A * 8/1977 Kraft ..... B66B 11/0226 187/324
4,361,208 A * 11/1982 Jackson ..... B66B 11/0226 187/401
5,564,529 A * 10/1996 Ericson ..... B66B 11/0206 187/401
6,880,678 B1 * 4/2005 Schneider ..... B66B 11/0246 187/314
7,281,609 B2 * 10/2007 Del Rio Sanz ..... B66B 5/0062 182/113
7,293,631 B2 * 11/2007 Ishii ..... B66B 11/008 187/250

(Continued)

FOREIGN PATENT DOCUMENTS

CN 105692403 A 6/2016
CN 107673173 A 2/2018

(Continued)

OTHER PUBLICATIONS

"Crosshead Mtd Collapsible Toch [56-96W×75-110 Deep]", wurtec, 2015 [retrieved via internet at https://www.wurtec.com/en/product/elevator-components-top-of-car-handrail/crosshead-mtd-collapsible-toch-56-96w-x-75-110-deep--18-465-C?pageid=21], Accessed Apr. 13, 2018; 3 pages.

(Continued)

*Primary Examiner* — Michael A Riegelman
(74) *Attorney, Agent, or Firm* — Cantor Colburn LLP

(57) ABSTRACT

Elevator car frames are provided. The elevator car frames include a first upright, a second upright, a first support element connected to the first upright, a second support element connected to the second upright, and a retractable crosshead having a first portion and a second portion extending between the first and second support elements, wherein the retractable crosshead is operable between a first state wherein the first portion and the second portion are connected and a second state wherein the first portion and the second portion are separated.

20 Claims, 5 Drawing Sheets

(56) References Cited

U.S. PATENT DOCUMENTS

| | | | | |
|---|---|---|---|---|
| 7,510,056 | B2 * | 3/2009 | Bonatre | B66B 5/0081 187/401 |
| 7,523,809 | B2 * | 4/2009 | Monzon-Simon | B66B 5/0056 182/148 |
| 8,365,870 | B2 * | 2/2013 | Sirigu | B66B 13/22 187/306 |
| 8,800,724 | B1 * | 8/2014 | Foster | B66B 19/00 187/414 |
| 2004/0035647 | A1 * | 2/2004 | Arai | B66B 11/0226 187/401 |
| 2004/0195049 | A1 * | 10/2004 | Stobo | B66B 11/0253 187/401 |
| 2007/0089936 | A1 * | 4/2007 | Zeng | B66B 11/0206 187/250 |
| 2012/0048658 | A1 * | 3/2012 | Brugger | B66B 11/0273 187/401 |
| 2012/0085032 | A1 * | 4/2012 | Heikintupa | E04B 9/003 49/104 |
| 2013/0220742 | A1 * | 8/2013 | Mielonen | B66B 11/0206 187/401 |
| 2014/0374197 | A1 * | 12/2014 | Lohr | B66B 11/0226 187/401 |
| 2016/0167923 | A1 * | 6/2016 | Pirttiniemi | B66B 11/0226 187/401 |
| 2018/0118519 | A1 * | 5/2018 | Fonteneau | B66B 11/0206 |
| 2018/0339879 | A1 * | 11/2018 | Quaretti | B66B 3/023 |
| 2019/0031472 | A1 * | 1/2019 | Salin | B66B 11/0226 |
| 2019/0263629 | A1 * | 8/2019 | Fernandez | B66B 11/0246 |
| 2019/0263630 | A1 * | 8/2019 | Fauconnet | B66B 13/285 |
| 2019/0330023 | A1 * | 10/2019 | Fauconnet | B66B 11/0206 |
| 2019/0389698 | A1 * | 12/2019 | Jimenez-Gonzalez | B66B 11/0246 |

FOREIGN PATENT DOCUMENTS

| | | | |
|---|---|---|---|
| EP | 1386876 | A1 | 2/2004 |
| EP | 1422185 | A1 | 5/2004 |
| EP | 2033927 | A1 | 3/2009 |
| EP | 3031764 | A1 | 6/2016 |
| GB | 2158038 | A | 11/1985 |
| WO | 2007032080 | A1 | 3/2007 |
| WO | 2008136118 | A1 | 11/2008 |
| WO | 2013030434 | A1 | 3/2013 |
| WO | 2017102966 | A1 | 6/2017 |

OTHER PUBLICATIONS

European Search Report for European Application No. 18305531.8, International Filing Date Apr. 27, 2018, dated Nov. 20, 2018, 7 pages.

* cited by examiner

ELEVATOR CAR FRAME

CROSS REFERENCE TO RELATED APPLICATIONS

This application claims the benefit of European Application No. 18305531.8, filed Apr. 27, 2018, which is incorporated herein by reference in its entirety.

BACKGROUND

The subject matter disclosed herein generally relates to elevator systems and, more particularly, to support structures and frames for elevator cars.

Elevator systems are used to transport passengers within buildings between floors of the building. Elevators include various components located within an elevator shaft (either affixed to the shaft or on an exterior of an elevator car). From time to time, maintenance is performed upon such components, such as inspection, repair, replacement, etc., as appreciated by those of skill in the art.

Entering an elevator shaft has risks and thus reducing the amount of exposure of mechanics and other authorized personnel to the elevator shaft is advantageous. Further, there is a trend to reduce the volumetric footprint of elevator systems within buildings, and thus reducing the required space for various components has advantages. However, to accommodate such improvements, changes in the elevator car frame may be required. Accordingly, it may be beneficial to have improved elevator car frame systems that provide structural support to the elevator car while enabling other modifications to the elevator system.

SUMMARY

According to some embodiments, elevator car frames are provided. The elevator car frames include a first upright, a second upright, a first support element connected to the first upright, a second support element connected to the second upright, and a retractable crosshead having a first portion and a second portion extending between the first and second support elements, wherein the retractable crosshead is operable between a first state wherein the first portion and the second portion are connected and a second state wherein the first portion and the second portion are separated.

In addition to one or more of the features described above, or as an alternative, further embodiments of the elevator car frames may include that the first portion is movably connected to the first support element.

In addition to one or more of the features described above, or as an alternative, further embodiments of the elevator car frames may include that the first portion is pivotably connected to the first support element.

In addition to one or more of the features described above, or as an alternative, further embodiments of the elevator car frames may include that the second portion is movably connected to the second support element.

In addition to one or more of the features described above, or as an alternative, further embodiments of the elevator car frames may include that the second portion is pivotably connected to the second support element.

In addition to one or more of the features described above, or as an alternative, further embodiments of the elevator car frames may include a first locking element releasably securing the first portion to the first support element when in the first state.

In addition to one or more of the features described above, or as an alternative, further embodiments of the elevator car frames may include a second locking element releasably securing the second portion to the second support element when in the first state.

In addition to one or more of the features described above, or as an alternative, further embodiments of the elevator car frames may include a third locking element releasably securing the first portion to the second portion when in the first state.

In addition to one or more of the features described above, or as an alternative, further embodiments of the elevator car frames may include a safety device arranged to be connected when in the first state and disconnected when in the second state.

In addition to one or more of the features described above, or as an alternative, further embodiments of the elevator car frames may include that the safety device is part of an elevator safety chain.

In addition to one or more of the features described above, or as an alternative, further embodiments of the elevator car frames may include that the safety device comprises a first safety element on the first portion and a second safety element on the second portion, wherein when the first safety element is removed from contact with the second safety element, the safety device is disconnected.

In addition to one or more of the features described above, or as an alternative, further embodiments of the elevator car frames may include that the first support element is integrally formed with the first upright and the second support element is integrally formed with the second upright.

Accordingly to some embodiments, elevator cars are provided. The elevator cars include an elevator car frame in accordance with any of the above described embodiments.

In addition to one or more of the features described above, or as an alternative, further embodiments of the elevator cars may include that the elevator car includes a ceiling panel openable to provide access to the retractable crosshead.

In addition to one or more of the features described above, or as an alternative, further embodiments of the elevator cars may include that the elevator car includes a maintenance platform that is operable to enable a user to access the retractable crosshead when the ceiling panel is open.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
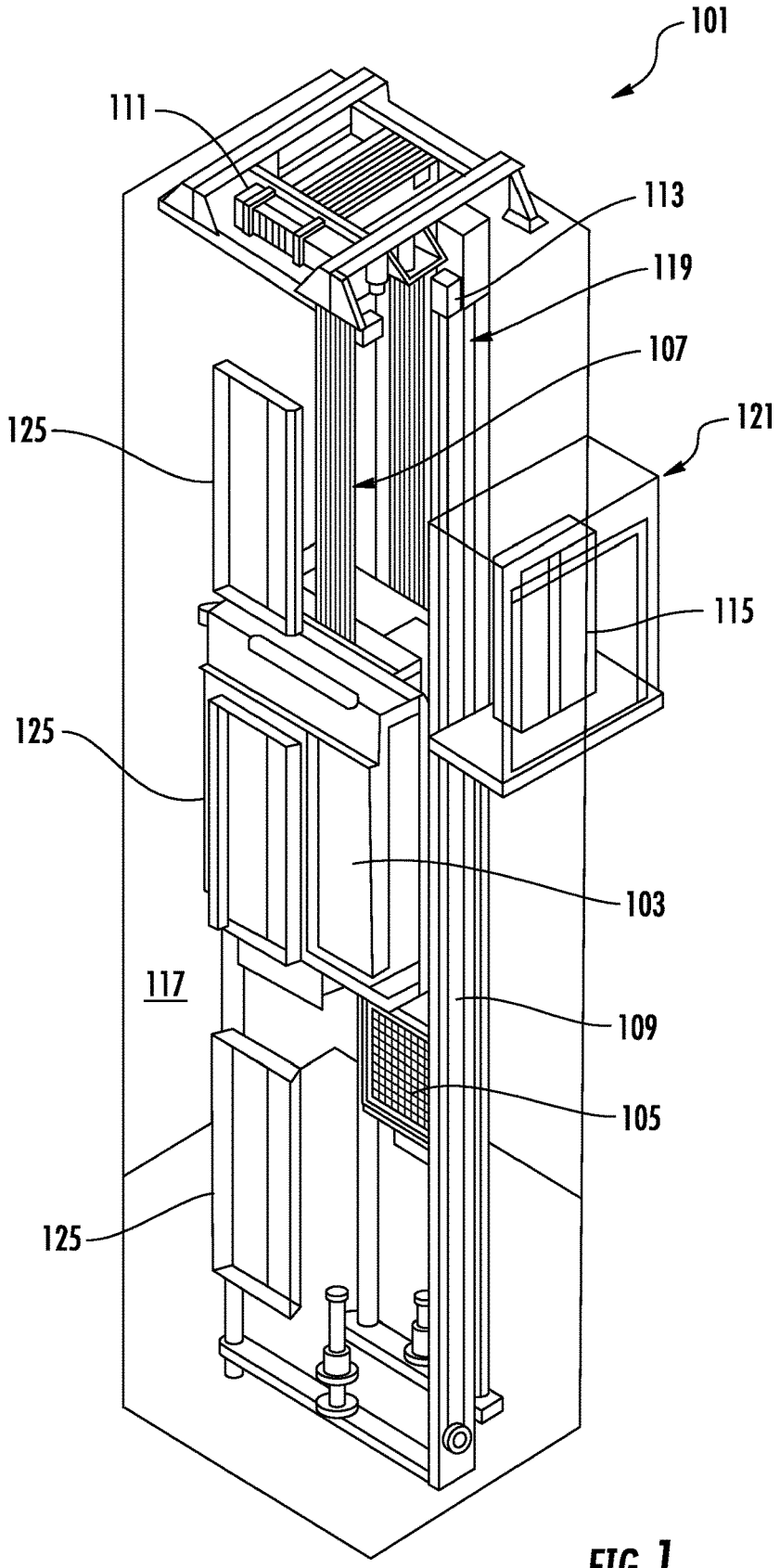
FIG. 1 PRIOR ART
FIG. 1 is a schematic illustration of an elevator system that may employ various embodiments of the disclosure.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
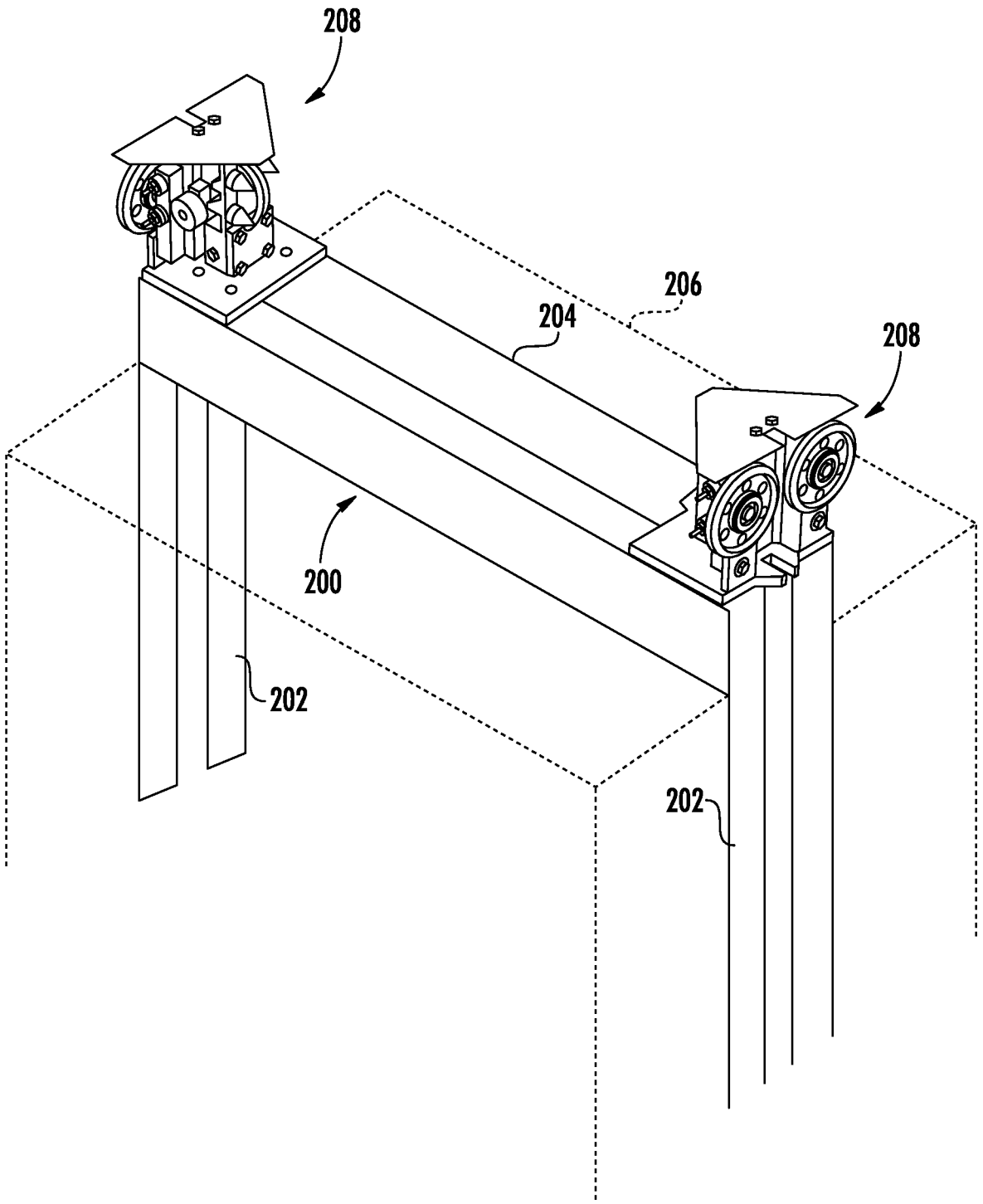
FIG. 2 PRIOR ART
FIG. 2 is a side schematic illustration of an elevator car frame that may incorporate embodiments of the present disclosure.

Turning now to FIG. 2, a schematic illustration of an elevator car frame 200 that may incorporate embodiments of the present disclosure is shown. The elevator car frame 200 includes vertical stiles or uprights 202 and a crosshead 204. The elevator car frame 200 is positioned and installed about an elevator car 206 to provide support thereto. Further, as shown, one or more elevator car components 208 may be installed to the elevator car frame 200. In this illustrative embodiment, the elevator car components 208 are guiding systems that are arranged to engage with a guide rail of an elevator system. Those of skill in the art will appreciate that other components may be installed to the elevator car frame 200 and/or to the elevator car 206 itself. Further, in some embodiments, no components may be installed directly to the elevator car frame 206, and the present illustration is provided for illustrative and explanatory purposes only, and is not to be limiting.

At times, it may be necessary for mechanics or other authorized personnel to access the elevator car components 208 or other components of an elevator system within an elevator shaft. In some elevator car configurations, an access panel may be arranged within the ceiling of the car such that the mechanic may open the access panel and access the elevator shaft from within the elevator car. However, as shown in FIG. 2, the crosshead 204 may block or partially block a portion of the top of the elevator car 206. Accordingly, one solution is to remove the crosshead and reinforce the rest of the elevator car frame. However, it may be beneficial to keep the crosshead for structural support. Accordingly, embodiments provided herein are directed to a retractable crosshead of an elevator car frame.

Figure 3:
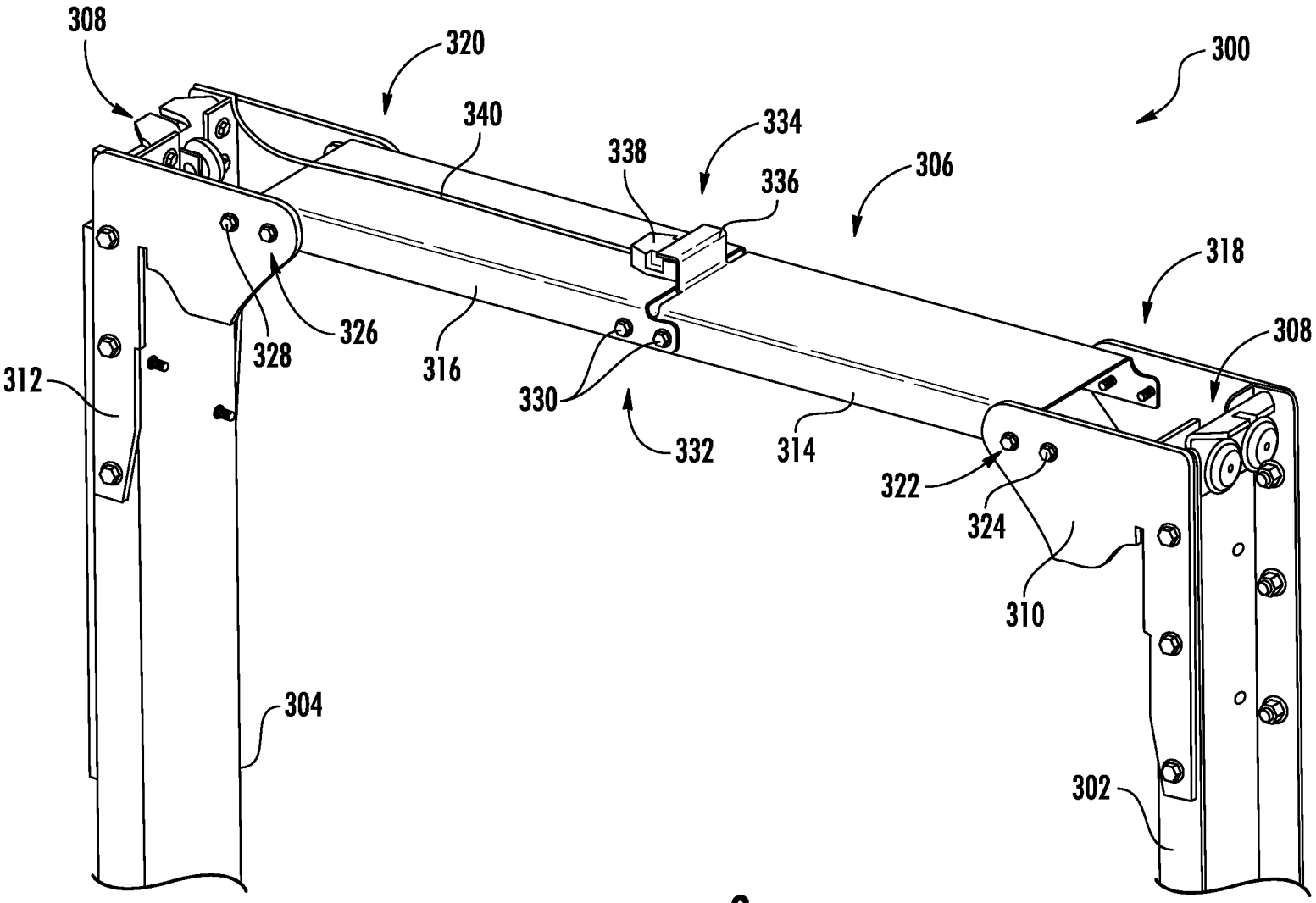
FIG. 3 is a schematic illustration of a retractable elevator car frame in accordance with an embodiment of the present disclosure.

Turning now to FIG. 3, a schematic illustration of a retractable elevator crosshead car frame assembly 300 is shown. The retractable elevator crosshead car frame assembly 300 is part of an elevator car frame that provides support to an elevator car within an elevator system. The retractable elevator crosshead car frame assembly 300, as shown in FIG. 3, includes a first upright 302, a second upright 304, and a retractable crosshead 306 extending between the uprights 302, 304. The uprights 302, 304 may house one or more elevator components 308, such as guiding elements or rollers, brakes, emergency braking systems, etc.

The retractable crosshead 306 is supported by a first support element 310 on the first upright 302 and is supported by a second support element 312 on the second upright 304. The support elements 310, 312 may be brackets or structural panels or elements that allow for moveable connection (e.g., pivots, slides, complete removal, etc.) with a portion of the retractable crosshead 306, as described herein. The support elements 310, 312, as illustratively shown, are separate elements from the uprights 302, 304 and are fixedly connected to them by one or more fasteners. However, in some embodiments, the support elements 310, 312 may be integrally formed with the respective upright 302, 304, thus forming a unitary or single body/structure.

The retractable crosshead 306 includes a first portion 314 and a second portion 316 that are releasably connected to each other. At a first end 318, 320 of each of the first portion 314 and the second portion 316 (i.e., opposite from the ends that are releasable connected), the portions 314, 316 are connected to the support elements 310, 312. For example, as shown, the first portion 314 of the retractable crosshead 306 engages with the first support element 310 at the first end 318 of the first portion 314 and thus is supported and connected to the first upright 302. Similarly, the second portion 316 of the retractable crosshead 306 engages with the second support element 312 at the first end 320 of the second portion 316 and thus is supported and connected to the second upright 304. In embodiments where the support elements 310, 312 are integral parts of the respective uprights 302, 304, the first and second portions 314, 316 connect or attach directly to the uprights 302, 304. In some such embodiments, the support elements of the uprights are arranged as pivots and/or locking elements directly in or part of the uprights.

The first portion 314 movably connects to the first support element 310, such as by a first movable connection 322. The first movable connection 322 may be a pivot, a sliding engagement, a secure fixed connection (allowing for complete separation) etc. For example, as shown in this illustrative embodiments, the first portion 314 is movably connected to the first support element 310 by the first movable connection 322 configured as a pivot. A first locking element 324 fixedly connects the first portion 314 to the first support element 310 when engaged, thus preventing movement about the first movable connection 322. In some embodiments, the first locking element 324 is a removable fastener or pin. However, in other embodiments, the first locking element 324 may be a detent pin or biased detent arrangement that is operated to release the first portion 314 from fixed engagement with the first support element 310.

The second portion 316 movably connects to the second support element 312, such as by a second movable connection 326. The second movable connection 326 may be a pivot, a sliding engagement, a secure fixed connection (allowing for complete separation) etc. For example, as shown in this illustrative embodiments, the second portion 316 is movably connected to the second support element 312 by the second movable connection 326 configured as a pivot. A second locking element 328 fixedly connects the second portion 316 to the second support element 312 when engaged, thus preventing movement about the second movable connection 326. In some embodiments, the second locking element 328 is a removable fastener or pin. However, in other embodiments, the second locking element 328 may be a detent pin or biased detent arrangement that is operated to release the second portion 316 from fixed engagement with the second support element 312.

The first portion 314 and the second portion 316 are releasably connected by a third locking element 330 at a second end 332 of each of the first portion 314 and the second portion 316. The third locking element 330 can be one or more fasteners or elements to allow for releasable connection. Other types of locking elements may include pins, slide engagements, key locks, etc., as will be appreciated by those of skill in the art. When engaged with both the first portion 314 and the second portion 316, the third locking element 330 provides for a secure, rigid, and fixed connection of the first portion 314 to the second portion 316 and thus a structural crosshead (the retractable crosshead 306) is formed for providing support and structure to the retractable elevator crosshead car frame assembly 300, and the elevator car frame and elevator car. However, the third locking element 330 may be disengaged by a user to allow the first portion 314 to be separated from the second portion 316.

That is, the first and second portions 314, 316 can be separated to allow an opening or space to be formed thereby. The opening or space will allow for a user, such as a mechanic or other authorized person, to gain access to the exterior of an elevator car. However, the user may reengage the portions 314, 316 to form the retractable crosshead 306 and provide rigid support to the retractable elevator crosshead car frame assembly 300.

In some embodiments, the retractable elevator crosshead car frame assembly 300 can include a safety device 334. The safety device 334 is operably connected to an elevator safety chain, and when the first portion 314 is separated from the second portion 316, the safety device 334 is arranged to prevent operation of the elevator. For example, the safety device 334 may be a switch that is in a first state when the first portion 314 is connected to the second portion 316, and is in a second state when the first portion 314 is separated from the second portion 316. In the case of a part of an elevator safety chain, when the safety device 334 is in the first state, the safety chain is complete, and normal operation of the elevator system is possible. However, when the safety device 334 enters the second state (i.e., when the first portion 314 separates from the second portion 316), the safety chain is broken, thus preventing normal operation of the elevator car, as will be appreciated by those of skill in the art.

As shown in FIG. 3, the safety device 334 can include a first safety element 336 that is part of the first portion 314 and a second safety element 338 may be part of or mounted to the second portion 316. In this illustration, the first safety element 336 is a flange or extension of the first portion 314 of the retractable crosshead 306. Further, the second safety element 338 may be a switch that is contacted by the first safety element 336, and when the first safety element 336 is removed from contact with the second safety element 338, the safety chain is broken. As shown, the second safety element 338 is connected to the safety chain of an elevator system by an electrical connection 340. In some embodiments, the electrical connection 340 may be part of a running cable, as known in the art. In some embodiments, the electrical connection 340 may be eliminated or supplemented by a wireless communication performed at the second safety element 338. In some embodiments, both wireless and wired connection may be provided for redundancy.

Figure 4A:
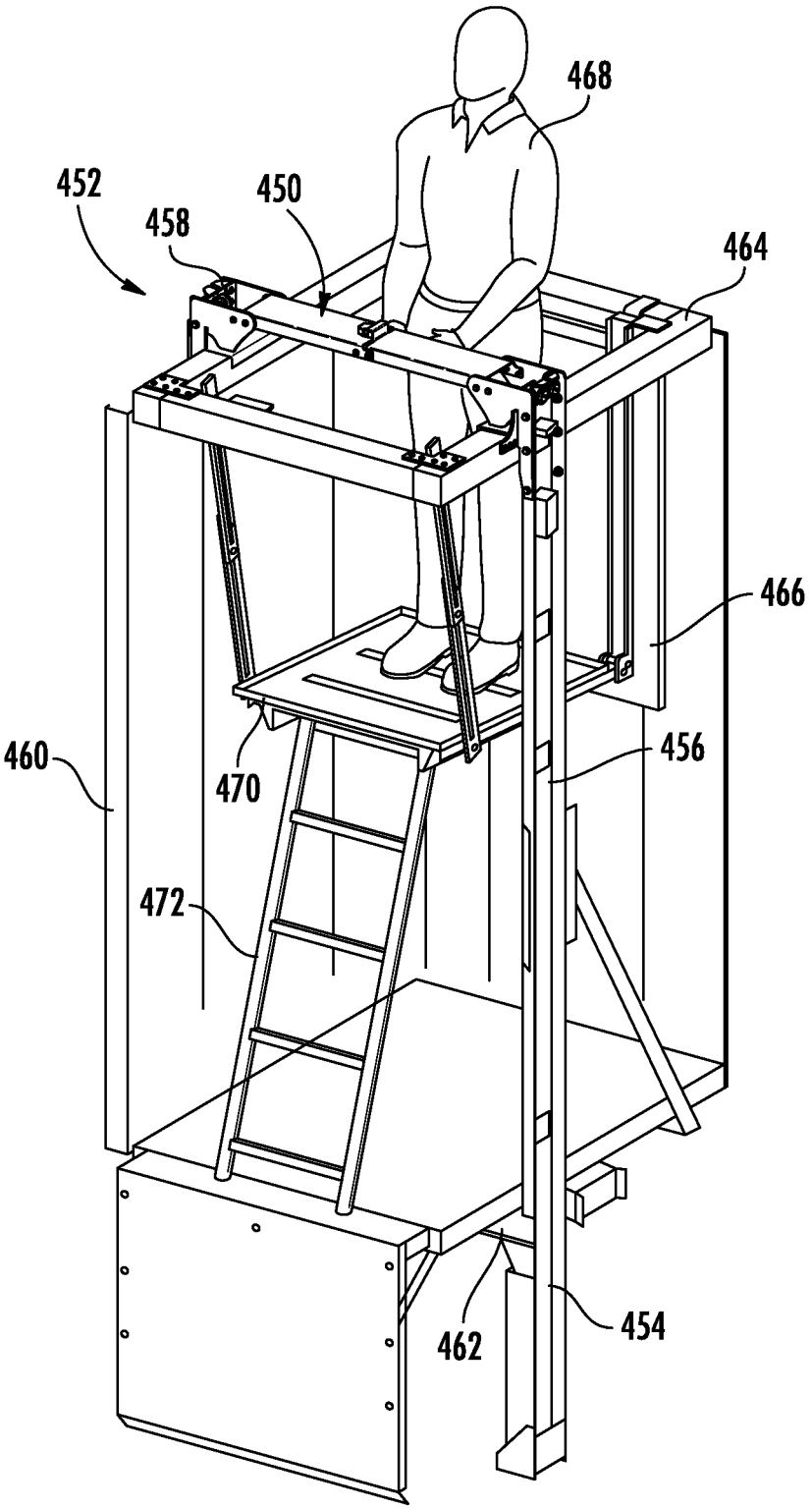
FIG. 4A is a schematic illustration of an elevator system with a retractable elevator car frame of the present disclosure shown in a first state.
Figure 4B:
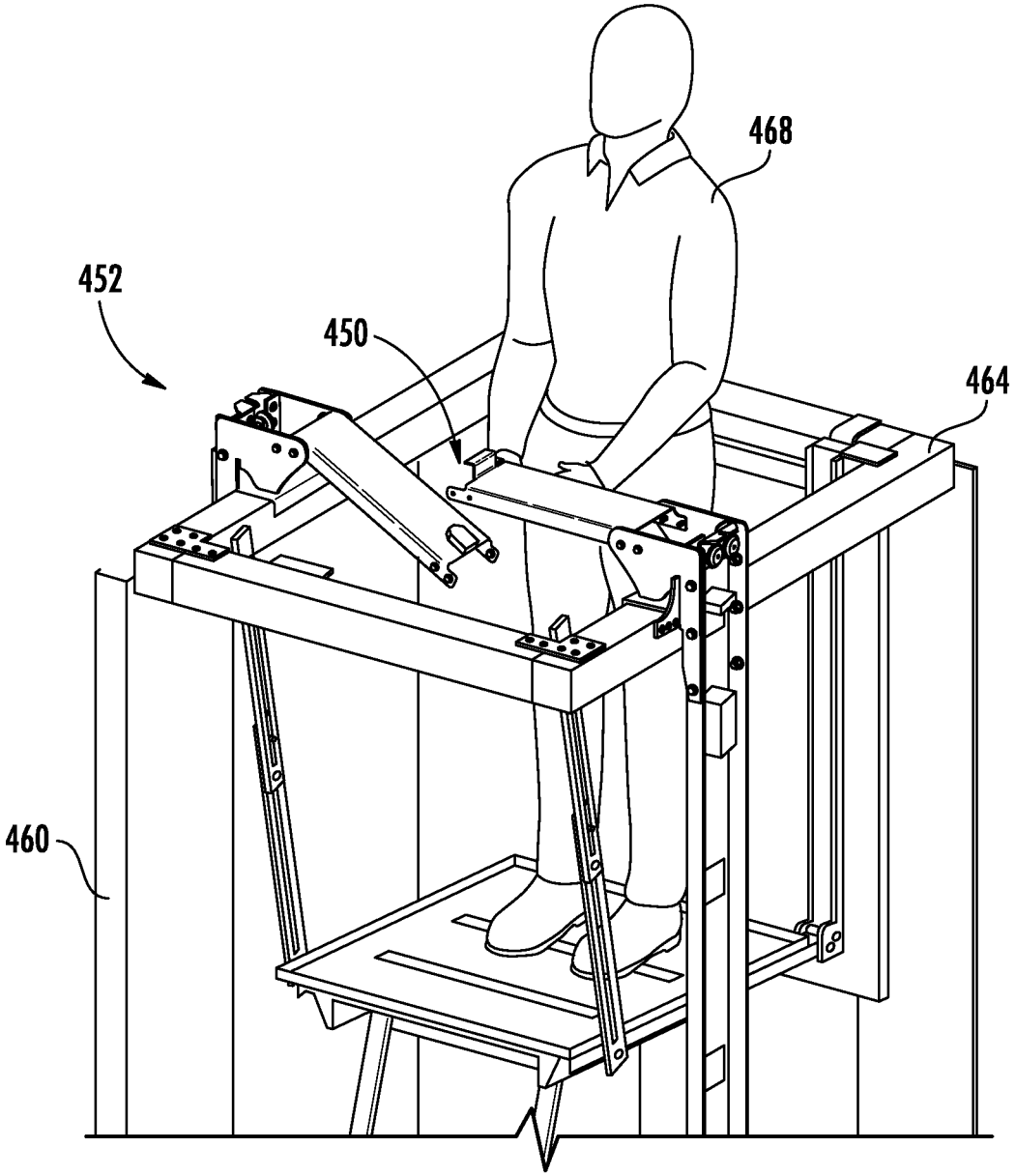
FIG. 4B is a schematic illustration of the retractable elevator car frame of FIG. 4A shown in a second state.

Turning now to FIGS. 4A-4B, schematic illustrations of operation of a retractable crosshead 450 of a retractable elevator crosshead car frame assembly 452 in accordance with an embodiment of the present disclosure are shown. The retractable elevator crosshead car frame assembly 452 is similar to that shown and described above, and thus similar features may not be labeled or described in detail again. The retractable elevator crosshead car frame assembly 452 is part of an elevator car frame 454. The elevator car frame 454 includes a first upright 456 and a second upright 458 that are joined above an elevator car 460 by the retractable elevator crosshead car frame assembly 452 and are joined below the elevator car 460 by a lower support frame element 462.

As shown, the elevator car 460 includes a car roof frame 464 that defines a ceiling of the elevator car 460. Further, as shown, with the elevator car 460 in a maintenance position, a ceiling panel 466 is opened to allow access to the roof or top of the elevator car 460. A mechanic 468 is shown standing on a maintenance platform 470 that is suspended from the car roof frame 464. When standing on the maintenance platform 470, the mechanic 468 may access and operate the retractable elevator crosshead car frame assembly 452 (e.g., open or retract the retractable crosshead 450). As shown, a ladder 472 may be used to provide access to the maintenance platform 470. Although a specific arrangement is shown herein to enable access to the roof of the elevator car 460, those of skill in the art will appreciate that other configurations are possible without departing from the scope of the present disclosure. For example, a larger ladder may be employed to enable the mechanic to reach the ceiling panel 466 and/or to access the retractable elevator crosshead car frame assembly 452. That is, the maintenance platform 470 may be an optional feature. In other embodiments, a pull-down ladder may be arranged as part of the ceiling panel 466. Accordingly, the present illustration is merely provided for illustrative and explanatory purposes and is not to be limiting, particularly with respect to how access is gained to the retractable elevator crosshead car frame assembly 452.

The retractable elevator crosshead car frame assembly 452 includes the retractable crosshead 450 having first and second portions that are releasably connected and supported on first and second support elements, as described above. Further, the retractable elevator crosshead car frame assembly 452 may include a safety device that is arranged between or on the first and second portions of the retractable crosshead 450. Thus, when the first and second portions of the retractable crosshead 450 are separated, a safety chain may be broken, or other safety action may be performed, as will be appreciated by those of skill in the art.

FIG. 4A illustrates the retractable crosshead 450 in a first position, such that the first and second portions are connected and the elevator car frame 454 is completed to provide structural support to the elevator car 460 (e.g., similar to arrangement shown in FIG. 3). However, as shown in FIG. 4B, the mechanic 468 may actuate or release the connection between the first and second portions of the retractable crosshead 450 to enable separation thereof. That is, as shown in FIG. 4B, the first and second portions of the retractable crosshead 450 are separated and retractable or moveable to allow a space to be opened for maintenance access. As such, the retractable crosshead 450 is opened and transitioned into a second state, which is illustratively shown in FIG. 4B. In the second state, the safety element is operated to prevent normal operation of the elevator car 460.

Accordingly, embodiments shown and described herein provide for an elevator car frame with a retractable upper crosshead component that is arranged to link the uprights of the car frame. The retractable crosshead has two operational positions or states. In normal operation, the retractable crosshead will be connected on both upper extremities of the uprights of the elevator car frame and will act as a conventional upper crosshead and contribute to the overall strength of the elevator car frame, and thus the elevator car. In the normal or first position, the elevator car can be used by passengers in normal operation.

However, in a maintenance or second state or position, the retractable crosshead enables a mechanic to gain access to components above an elevator car and/or within an elevator shaft. To gain such access, the mechanic will, in some embodiments, unfold a foldable celling panel in order operate or access a maintenance platform. Regardless of how the mechanic accesses the ceiling, the mechanic may then operate or actuate the retractable crosshead to gain access to components in the elevator shaft. During this operation, the mechanic will actuate, operate, collapse, or open the retractable crosshead in order to gain better, easier, and/or safer access to components within an elevator shaft.

As noted above, the transition from the first state or position to the second state or position of the retractable crosshead may actuate a safety device. That is, the state of the retractable crosshead may be monitored by a safety device, and when the state of the retractable crosshead changes to an open or second state/position, the safety device may prevent normal operation of the elevator system.

Advantageously, embodiments disclosed herein provide for improved maintenance access for elevator systems. Further, advantageously, cost reductions of elevator car frames may be realized due to the improved upper frame. Moreover, a need to provide for strengthened or reinforced lower car frames may be eliminated.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator car frame comprising:

a first upright;

a second upright;

a first support element connected to the first upright;

a second support element connected to the second upright; and a retractable crosshead having a first portion and a second portion extending between the first and second support elements, wherein the first portion and the second portion of the retractable crosshead are releasably connected to each other at one end thereof and each of the first portion and the second portion are connected to the respective first support element and the second support element at an opposed end thereof, and wherein the retractable crosshead is operable between a first state wherein the first portion and the second portion are connected and a second state wherein the first portion and the second portion are separated to form an opening that provides access to an exterior of an elevator car having the elevator car frame.

2. The elevator car frame of claim 1, wherein the first portion is movably connected to the first support element.

3. The elevator car frame of claim 2, wherein the first portion is pivotably connected to the first support element.

4. The elevator car frame of claim 1, wherein the second portion is movably connected to the second support element.

5. The elevator car frame of claim 4, wherein the second portion is pivotably connected to the second support element.

6. The elevator car frame of claim 1, further comprising a first locking element releasably securing the first portion to the first support element when in the first state.

7. The elevator car frame of claim 1, further comprising a second locking element releasably securing the second portion to the second support element when in the first state.

8. The elevator car frame of claim 1, further comprising a third locking element releasably securing the first portion to the second portion when in the first state.

9. The elevator car frame of claim 1, further comprising a safety device arranged to be connected when in the first state and disconnected when in the second state.

10. The elevator car frame of claim 9, wherein the safety device is part of an elevator safety chain.

11. The elevator car frame of claim 9, wherein the safety device comprises a first safety element on the first portion and a second safety element on the second portion, wherein when the first safety element is removed from contact with the second safety element, the safety device is disconnected.

12. The elevator car frame of claim 1, wherein the first support element is integrally formed with the first upright and the second support element is integrally formed with the second upright.

13. An elevator car comprising:

an elevator car frame having:

a first upright;

a second upright;

a first support element connected to the first upright;

a second support element connected to the second upright; and a retractable crosshead having a first portion and a second portion extending between the first and second support elements, wherein the first portion and the second portion of the retractable crosshead are releasably connected to each other at one end thereof and each of the first portion and the second portion are connected to the respective first support element and the second support element at an opposed end thereof, and wherein the retractable crosshead is operable between a first state wherein the first portion and the second portion are connected and a second state wherein the first portion and the second portion are separated to form an opening that provides access to an exterior of an elevator car having the elevator car frame.

14. The elevator car of claim 13, wherein the elevator car includes a ceiling panel openable to provide access to the retractable crosshead.

15. The elevator car of claim 14, wherein the elevator car includes a maintenance platform that is operable to enable a user to access the retractable crosshead when the ceiling panel is open.

16. The elevator car of claim 13, wherein the first portion is movably connected to the first support element.

17. The elevator car of claim 13, wherein the second portion is movably connected to the second support element.

18. The elevator car of claim 13, further comprising a first locking element releasably securing the first portion to the first support element when in the first state.

19. The elevator car of claim 13, further comprising a second locking element releasably securing the second portion to the second support element when in the first state.

20. The elevator car of claim 13, further comprising a third locking element releasably securing the first portion to the second portion when in the first state.

* * * * *